US005988454A

United States Patent [19]

Ellion

[11] Patent Number: 5,988,454

[45] **Date of Patent: *Nov. 23, 1999**

[54] LEAK-RESISTANT MANUALLY OPERATED PUMP SPRAYER

[76] Inventor: M. Edmund Ellion, 3660 Woodstock Rd., Santa Ynez, Calif. 93460

[ * ] Notice: This patent is subject to a terminal disclaimer.

[21] Appl. No.: 09/285,246

[22] Filed: Apr. 2, 1999

Related U.S. Application Data

[63] Continuation-in-part of application No. 08/949,418, Oct. 14, 1997, Pat. No. 5,899,361.

[51] Int. Cl.[6] ..... B67D 5/40

[52] U.S. Cl. ..... 222/376; 222/377; 222/382

[58] Field of Search ..... 222/376, 377, 222/382, 383.1, 481.5, 402.19, 464.7

[56] References Cited

U.S. PATENT DOCUMENTS

| | | |
|---|---|---|
| 3,733,013 | 5/1973 | Doyle . |
| 4,072,252 | 2/1978 | Steyns et al. . |
| 4,775,070 | 10/1988 | Williams . |
| 5,353,969 | 10/1994 | Balderrama . |
| 5,624,060 | 4/1997 | Ellion et al. . |
| 5,779,108 | 7/1998 | Barriac et al. . |
| 5,899,366 | 5/1999 | Ellion ..... 222/376 |

*Primary Examiner*—Philippe Derakshani
*Attorney, Agent, or Firm*—Watson Cole Grindle Watson, P.L.L.C.

[57] ABSTRACT

A manually operated pump sprayer that does not leak contents through the air inlet vent port during operation when the bottle is oriented so that the inlet vent port would be covered with liquid in a spray bottle to which the sprayer is mounted. The pump sprayer is devised as having an air inlet unit which includes the air inlet vent port in liquid communication with an extension tube which in turn is in liquid communication with a storage volume which in turn is in liquid communication with a liquid control orifice. An entrance end to the tube is positioned at a location farthest from the discharge exit opening of the sprayer, and the liquid control orifice is positioned closer to the exit opening such that when spraying in a downward direction such entrance end is always above the liquid level in the storage volume. Otherwise the entrance end is arranged as to be closer to the exit opening compared to the liquid control orifice such that when spraying in an upward direction the entrance end is above the liquid level in the storage volume.

5 Claims, 5 Drawing Sheets

S
4DD
4DD
E 31
33
35
30

S
4CC
4CC
E 33
31
35
30

S
4BB
4BB
E 33
31
35
30

S
4AA
4AA
E 34
33
30
31
32
35

5AA
5AA
E
S

E
5BB
5BB
S

E
5CC
5CC
S

S
E
5DD
5DD 30
31
32
35
33
34

30
35
31

30
35
31

31
35
30

LEAK-RESISTANT MANUALLY OPERATED PUMP SPRAYER

CROSS REFERENCE TO OTHER APPLICATION

This is a continuation-in-part of application Ser. No. 08/949,418, filed Oct. 14, 1997, now U.S. Pat. No. 5,899,366 entitled "Leak-Resistant Hand-Pump Spray Bottle."

BACKGROUND OF THE INVENTION

This invention relates to hand-pump spray bottles for dispensing a liquid in a jet or atomization mode and, more particularly, to such a hand-pump having a novel air inlet unit that prevents the liquid from leaking out of the air inlet unit when the container is operated at an orientation that causes the air inlet unit to be covered with liquid.

Hand-pump spray bottles have become increasingly popular to eliminate the use of pressurized cans due to environmental concerns and high cost. Over one billion spray bottles are sold each year to dispense such liquids as glass cleaners, bathroom cleaners, waxes and oils.

These spray bottles have a feed tube with an open distal end that extends into the liquid contents and serves as a conduit to the hand-pump. There is an air inlet port, usually located in the hand-pump, that admits air into the bottle during part of the pump suction and pressure discharge stoke. This admitted air replaces the liquid that is dispensed in order to maintain approximately atmospheric pressure with the bottle. These spray bottles operate well under some conditions. However, if the feed tube distal end is within the liquid and the air inlet port is covered with liquid, as would occur when the bottle is operated at certain commonly encountered orientations, the hand-pump will dispense the liquid satisfactorily but liquid will leak out of the air inlet port. This leakage occurs with conventional spray bottles as well as with any of the numerous bottles that can operate in the inverted position, such as described in U.S. Pat. Nos. 3,733,013; 4,775,079; and 5,624,060. This leakage is highly undesirable for any liquid since it is unpleasant to wet the hand and it is a waste of product. Any leakage, even the smallest amount, is completely unacceptable for any caustic liquids.

U.S. Pat. No. 4,072,252 discloses a hand-operated sprayer (FIG. 1 of the present drawings) that allows air to enter the bottle to replace the dispensed fluid in order to prevent the collapse of the bottle and to seal against liquid leakage from the bottle when the pump is not operated. This general concept is employed in most current trigger hand-pumps. Of particular and unique interest are passages 10 and 11 illustrated in FIG. 1 of the present drawings. The detailed description and operation of the '252 sprayer states that passage 10 in FIG. 1 (33 in the patent) "may be formed as a capillary tube of fine diameter whereby liquid leakage which might occur will be insignificant, yet air passage will be uninhibited." It will be shown in the detailed description of the present application that the short capillary tubes 10 and 11 of that prior art sprayer will not prevent leakage but merely restrict the quantity that is leaked.

U.S. Pat. No. 5,353,969 discloses a pump sprayer having a spiral vent path as shown in FIG. 2 of the present drawings. Like U.S. Pat. No. 4,072,252, the air vent restricts the liquid leakage by employing a small cross-sectional groove but additionally provides a long path to inhibit the flow of the liquid to the atmosphere. The spiral vent groove 21 illustrated in FIG. 2 is stated as having a length to restrict the free flow of liquid therethrough to avoid leakage and being sized so that, while dispensing in the inverted position, the rate of liquid discharge from the container is greater than the flow of air through the vent groove which thereby creates a vacuum in the container and effects a suck-back of air through the vent into the container. It will be shown in the following detailed description that the length of the spiral groove to prevent any leakage would have to be quite long and thus would not be practical for existing hand-pumps.

The aforementioned 366 parent patent discloses a hand-pump spray bottle that does not leak during hand-pump operation when held at an orientation where the liquid would normally contact the air inlet port. In that invention, the air inlet port is in circuit with a tubular section that acts as a holding volume for the liquid that would normally cover the air inlet port and leak to the atmosphere. Since the liquid is contained in the tubular section it will not leak into the atmosphere. While this invention will prevent leakage, the tubular section is too large to be accommodated in some hand-pumps. The size of the tubular section that is required in that invention is determined by the size of the air inlet port. When oriented so that liquid contacts the tubular section and the air inlet port is opened, as would occur during the operation of the hand-pump, the rate at which liquid enters the tubular section is controlled by the rate at which air flows out of the tubular section through the air inlet port to the atmosphere. The volumetric flow of air out of the tubular section through the air inlet port is inversely proportional to the square root of the density of the air. Since the density of the air is small compared to the liquid density, the size of the tubular section must be relatively large when controlled by the size of the air inlet port as compared to being controlled by a liquid orifice as in this invention. Since the minimum size of the air inlet port is limited by the manufacturing processes, the size of the tubular section is too large to be incorporated in some hand-pumps. The desirability of controlling the size of the tubular section (storage volume) by a liquid orifice rather than an air orifice will be made clear in the following description.

There is a need to provide an air inlet unit that can be incorporated into any hand-pump spray bottle that will admit air but will prevent any leakage of the liquid contents when the bottle is held at an orientation so that the air inlet port normally would be covered with liquid.

SUMMARY OF THE INVENTION

The present invention is directed to a hand-pump having an air inlet unit that will allow air to enter a spray bottle in order to replace the dispensed liquid but will prevent liquid from leaking when the bottle is oriented so that liquid would normally cover the air inlet port. The air inlet unit has four components: (1) a liquid control orifice to limit the flow of liquid into the storage volume, (2) a storage volume that contains the liquid that would otherwise leak to the atmosphere, (3) an extension tube to prevent liquid in the storage volume from reaching the air inlet port, and (4) an air inlet port which allows atmospheric air to enter the bottle. The liquid control orifice is in circuit with the interior of the bottle and also in circuit with the storage volume. The storage volume in turn is in circuit with the extension tube which also is in circuit with the air inlet port.

During inverted operation when the liquid control orifice is covered with liquid, the volume of liquid that can flow through the liquid control orifice is restricted to be less than the volume of the storage volume. The entrance to the extension tube is always above the liquid level in the storage volume and thus prevents liquid from reaching the air inlet tube. As the liquid is dispensed from the spray bottle, the pressure therein decreases. When the pressure within the spray bottle is reduced to a value equal to the atmospheric pressure minus the product of the height of the liquid above the liquid control orifice and the density of the liquid, atmospheric air can enter the spray bottle to replace the dispensed liquid and maintain the pressure thereafter substantially constant.

During upright operation, any liquid in the storage volume drains through the liquid control orifice back into the spray bottle. Air can then enter the bottle freely through the air inlet unit to replace the dispensed liquid and maintain the pressure therein substantially equal to atmospheric.

The size of the storage volume, which contains the liquid that would otherwise leak to the atmosphere, is controlled by the size of the liquid control orifice, the height of the liquid in the bottle and the rate at which the liquid is dispensed by the hand-pump. The relationship between these three parameters is:

$$V=CA(2gH)^{1/2}[V_b/(V_S \times S)]$$

Where: V=size of storage volume,

C=coefficient of discharge through the liquid control orifice,

A=cross-sectional area of the liquid control orifice, g=acceleration of gravity, H=height of the liquid level in the bottle above the liquid control orifice, $V_b$=volume of the liquid that must be removed from the bottle to reduce air pressure therein to a value of (H×d) below atmospheric pressure, D=density of the liquid, $V_S$=volume of liquid dispensed for each stroke of the hand-pump, S=number of the strokes of the hand-pump per seconds.

The above and other features of the invention will be fully understood from the following detailed description and the accompanying drawings.

DETAILED DESCRIPTION OF THE INVENTION

Figure 3:
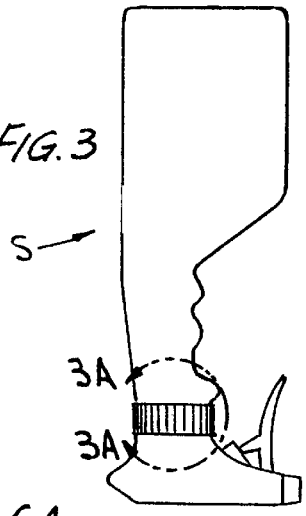
FIG. 3 illustrates a dispenser in an inverted position, FIG. 3A being an enlarged schematic of the major components of the non-leaking air inlet unit according to the invention taken at arrow 3A of FIG. 3.
Figure 3A:
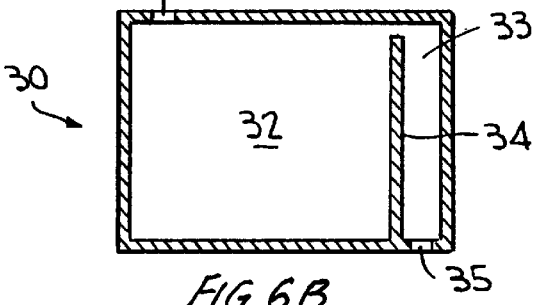

Referring to FIG. 3A, a liquid control orifice 31 separates the interior of the bottle from a storage volume 32. The storage volume 32 is the void that contains liquid that would have otherwise reached an entrance 33 to an extension tube 34. The extension tube 34 communicates the storage volume 32 with an air inlet port 35 which in turn communicates with the outer air. The four components together are referred to as an air inlet unit 30. In the conventional hand-pumps, the air inlet port is uncovered during a portion of both the suction stroke and the pressure discharge stroke of the hand-pump. FIG. 3A merely illustrates the basic four components of the air inlet unit 30 in a generic form and not in the form that is incorporated into an actual hand-pump, although the general location of unit 30 in a hand-pump sprayer S of FIG. 3 is generally indicated. The air inlet unit 30 is illustrated in the simplified form for ease of describing its operation. An example of a specific design of an air inlet unit incorporated into an existing trigger hand-pump will be described later.

Figures 4A, 4B, 4C, 4D:
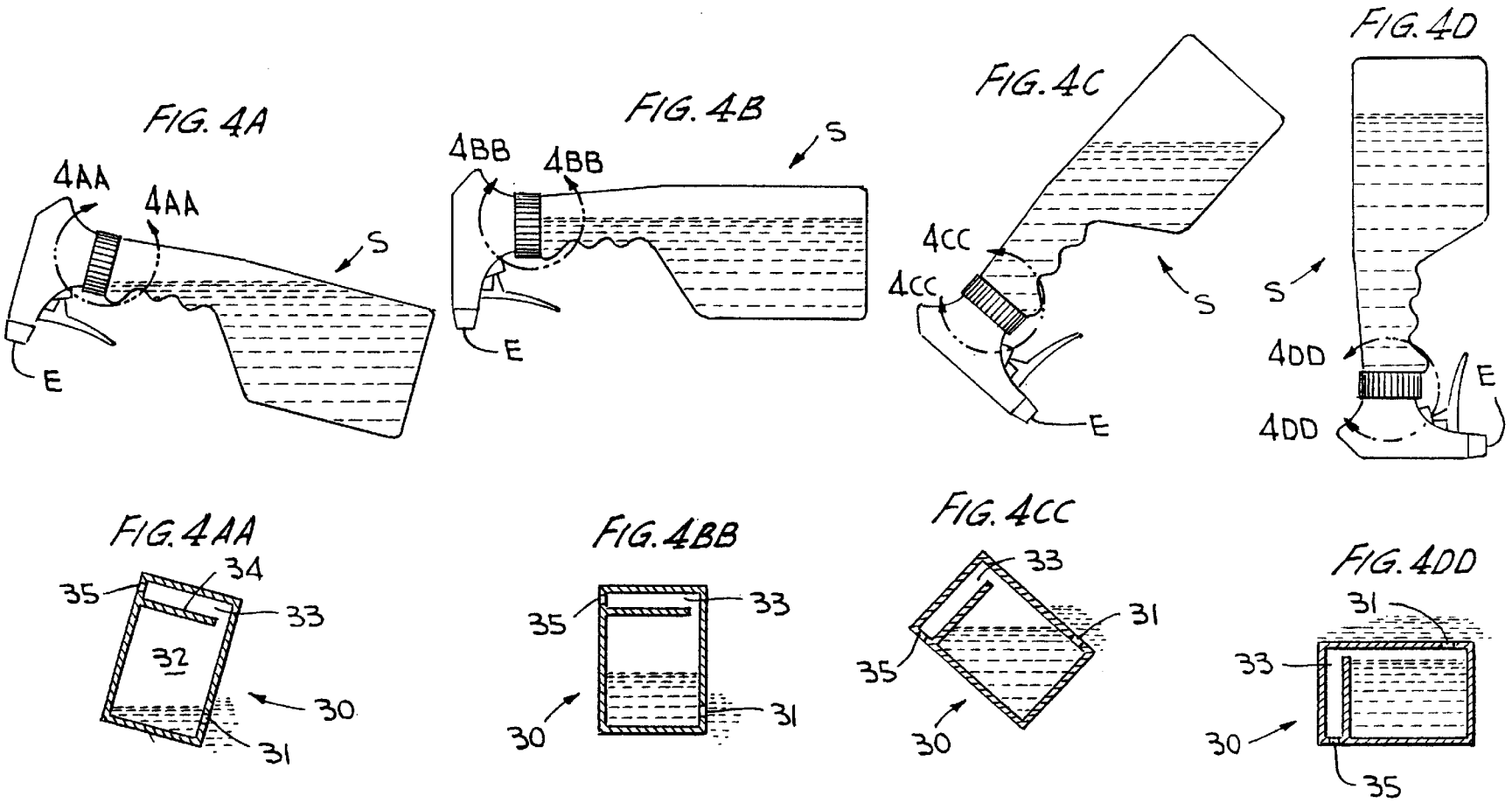
FIGS. 4A, 4B, 4C, 4D illustrate a dispenser in various orientations, FIGS. 4AA, 4BB, 4CC, 4DD illustrating in diagrammatical form the quantity of liquid that must be contained in the storage volume for the various orientations, taken at arrows 4AA, 4BB, 4CC, 4DD, of the bottle when spraying in a downward direction.

FIGS. 4A, 4B, 4C, 4D illustrate a typical hand-pump sprayer S in various inverted positions so that liquid contacts the liquid control orifice 31 as shown in FIGS. 4AA, 4BB, 4CC, 4DD. It should be noted that the components of unit 30 are specifically arranged as shown to effect spray in only the various inverted positions. If the bottle is oriented to spray in a downward position such as that illustrated, but the hand-pump is not operated and the air in the bottle is at atmospheric pressure, the liquid in the bottle will drain through the liquid control orifice 31 into the storage volume 32 until the pressure in the storage volume 32 is equal to the pressure in the bottle plus the product of the density of the liquid and the height of the liquid level above the liquid control orifice 31. Since no air leaves the storage volume 32 when the hand-pump is not operated and some liquid has entered it, the pressure of the air in the storage volume 32 will increase in proportion to the amount of liquid that has entered it.

However, if the hand-pump is operated, the air inlet port 35 is uncovered during a portion of the suction stroke as well as a portion of the pressure discharge stroke allowing some of the air in the storage volume 32 (that is at a pressure exceeding atmospheric) to escape to the atmosphere. The resulting lower pressure in the storage volume 32 will allow more liquid to enter the storage volume.

As the hand-pump is continued to be operated and the air inlet port is continued to be opened intermittently, more of the air in the storage volume 32 will escape to the atmosphere and additional liquid will flow into the storage volume 32. If the hand-pump is continued to be operated, additional liquid will drain into the storage volume 32 until the pressure of the air in the bottle decreases to a value equal to atmospheric pressure minus the product of the density of the liquid and the height of the liquid above the liquid control orifice 31. At that time, the pressure in the storage volume 32 equals the atmospheric pressure and the air therein will not escape to the atmosphere. Additionally no further amount of liquid will drain into the storage volume 32.

It should be noted in FIGS. 4A to 4D, and the corresponding FIGS. 4AA, 4BB, 4CC, 4DD, that as the bottle is oriented more to the inverted position, the height of the liquid above the liquid control orifice 31 increases thereby increasing the pressure of the liquid at the liquid control orifice. The result is that more liquid will enter the storage volume 32 as the bottle is oriented more to the fully inverted position of FIGS. 4D, 4DD. It should be noted that for spraying in the downward direction the entrance end 33 to the extension tube 34 is located in the storage volume 32 farthest from the spray exit E of sprayer S and the liquid control orifice 31 is located closest to the spray exit E. This arrangement prevents liquid in the storage volume 32 from reaching the extension tube entrance 33 until the storage volume 32 is full (FIG. 4DD). In this illustration, the bottle is oriented to spray in a fully downward direction.

Figures 5A, 5B, 5C, 5D:
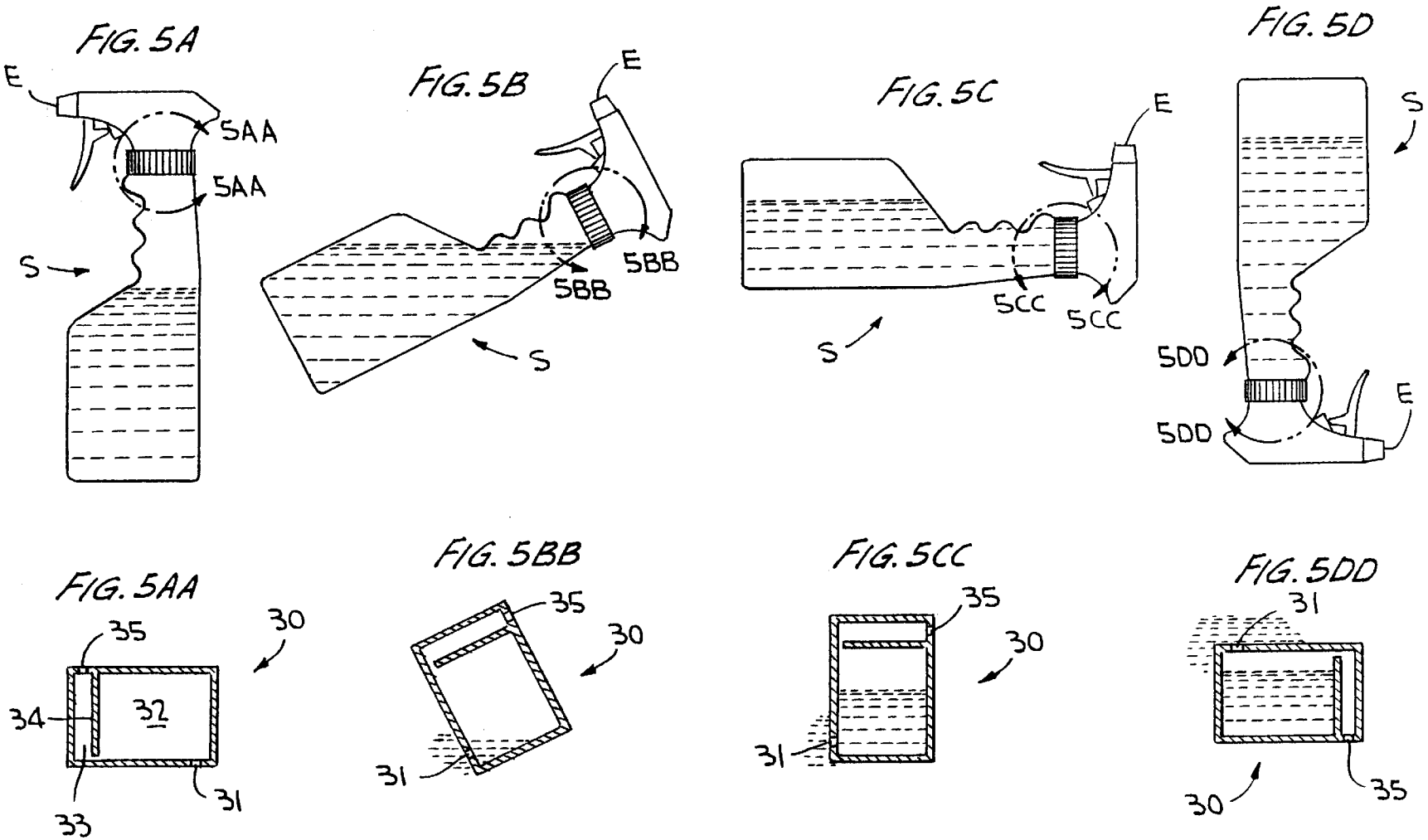
FIGS. 5A, 5B, 5C, 5D illustrate a dispenser in various orientations, FIGS. 5AA, 5BB, 5CC, 5DD illustrating in diagrammatical form the quantity of liquid that must be contained in the storage volume for the various orientations, taken at arrows 4AA, 4BB, 4CC, 4DD of the bottle when spraying in an upward direction.

When the bottle is oriented upright (FIG. 5A), the liquid in the storage volume 32 drains back into the bottle and air can enter the bottle freely to maintain the air pressure therein substantially atmospheric (FIG. 5AA).

If it is desired to spray in an upward direction as illustrated in FIGS. 5A to FIG. 5D, the extension tube 34 should be located closest to the spray exit E of sprayer S and the liquid control orifice 31 should be located farthest form the spray exit E as illustrated. This arrangement prevents liquid in the storage volume 32 from reaching the extension tube entrance 33 until the storage volume 32 is full (FIG. 5DD). In this illustration, the bottle is oriented to spray in an upward direction. It should be noted that the components of unit 30 in the FIG. 5 drawings are specifically arranged as shown to effect spray in only the various upright positions.

It will be instructive to calculate the required size of the storage volume to prevent external leakage for a typical 17 oz. spray bottle.

Consider the condition where the height of the liquid above the liquid control orifice 31 is 7 inches when the bottle is inverted and where there are 8 $in^3$. of air at atmospheric pressure in the bottle. If the hand-pump is operated so that the air inlet port 35 is uncovered, liquid will drain from the bottle through the liquid control orifice 31 into the storage volume 32 until the pressure in the bottle decreases to a value equal to the atmospheric pressure (14.7 psi) minus the height of the liquid level above the control orifice (7 in.) times the density of the liquid (0.036 $lb/in.^3$) or 14.448 psi. At that time the pressure of the air in the storage volume 32 would be approximately atmospheric and able to withstand the column of liquid in the bottle and prevent and further drainage into the storage volume 32.

Assuming isothermal expansion of the air in the bottle as liquid is removed, the volume of the air when the liquid stops entering the storage volume would be equal to the initial volume (8 $in.^3$) times the atmospheric pressure (14.7 psi) divided by the pressure of the air in the bottle (14.448 psi) or 8.14 $in^3$. Consequently, it is seen that 8.14−8.00=0.14 $in.^3$ of liquid must be removed before the liquid stops draining from the bottle into the storage volume 32. This quantity of liquid would be required if the bottle had rigid walls.

Typical plastic spray bottles do not have rigid walls and, as the liquid leaves the bottle, the flexible walls collapse slightly thereby tending to maintain a more constant air pressure. The result is that a greater quantity of liquid must be removed before the pressure in the bottle is decreased sufficiently to stop the flow through the liquid control orifice 31.

A simple test to determine the quantity of liquid that must be removed from any given type of flexible bottle can be conducted by removing the hand-pump and closing the bottle with a cap that has a small hole. The hole should be small enough to prevent atmospheric air from bubbling through the hole and into the bottle when the hole is covered with liquid. For most liquids to be dispensed in spray bottles, a hole having a diameter of 0.15 inches or less is acceptable. To conduct the test, the cap is placed on the bottle and the bottle is inverted. The amount of liquid that leaks out is measured. The quantity of leakage varies with the height of the liquid above the hole and the volume of air in the bottle: a greater height of liquid causes a faster flow through the hole but also has a smaller volume of air in the bottle so that less liquid needs to be removed before the air pressure is decreased an amount equal to the height of the liquid times the density of the liquid.

It is seen that the quantity of liquid that must be removed to reduce the air pressure in the bottle to the desired value when the bottle is inverted varies with the height of the liquid above the hole and the quantity of air in the bottle. Under the above conditions with the 7 inches of liquid above the hole, tests have shown that typical 17 oz. cylindrical bottles reach the required pressure of 14.448 psi after removing 0.34 $in.^3$ and typical flat-sided bottles will reach the required air pressure after removing 3.60 $in.^3$ of liquid. It should be noted that the storage volume does not have to accommodate all of this liquid since some of the liquid that must be removed to decrease the pressure in the bottle to 14.448 psi is being dispensed through a hand-pump. It is only necessary to hold a quantity of liquid in the storage volume 32 that is equal to the total required quantity minus the amount that is dispensed by the hand-pump.

The amount of the liquid that enters the storage volume 32 depends upon the rate of flow through the liquid control orifice 31 and the time of the flow. As a result, in order to determine the required size of the storage volume 32, it is necessary to know the time that the air inlet port 35 is open before the pressure in the bottle decreases to 14.448 psi, which in turn depends on the rate at which the hand-pump dispenses the liquid. A typical hand-pump for a 17 oz. bottle will dispense 0.07 $in.^3$/stroke. If the hand-pump is actuated two times a second, which is a typical speed, it will take approximately 1.7 seconds to remove sufficient liquid from the cylindrical bottle to stop liquid from entering the storage volume 32. This time was determined by knowing that 0.34 $in.^3$ of liquid must be removed from the cylindrical bottle in order to decrease the air pressure therein to 14.448 psi in order to stop the flow into the storage volume 32, knowing that 0.07 $in.^3$ is dispensed during each stroke of the hand-pump and that there are two strokes per second [0.34/(0.07×2)=2.4 sec]. In order to determine the size of the storage volume 32, it is now only necessary to calculate the amount of liquid that can flow through the liquid control orifice 31 in 2.4 sec. (This is a conservative estimate of the time since it considers that the pressure in the bottle is decreased only be the dispensed liquid and does not account for the liquid that drained into the storage volume 32; also, the air inlet port 35 is open only a portion of the time that the pump is actuated.) The volumetric flow through the liquid control orifice 31 can be determined by standard fluid dynamics as:

$$V=CA(2gH)^{1/2} \quad (1)$$

Where: v=volumetric flow per second,

C=coefficient of discharge through the liquid control orifice,

A=cross-sectional area of the liquid control orifice, g=acceleration of gravity, H=height of the liquid level in the bottle above the liquid control orifice.

The flow through a 0.020 in diameter liquid control orifice 31 with 7 inches of liquid would be:

$$V=0.6[\pi(0.020^2)/4](2\times386.4\times7)^{1/2}=0.0139 \text{ in.}^3/\text{sec.}$$

Since it requires 2.4 sec. to stop the flow through the liquid control orifice, the storage volume would have to be 0.0139×2.4=0.034 in.$^3$ for the typical cylindrical 17 oz. bottle.

Using the same analysis, the required storage volume for a flat-sided bottle would be 0.36 in$^3$. In the case of a flat sided bottle, the number of hand-pump strokes that are required to lower the pressure of the air in the bottle in order to stop the flow through the liquid control orifice 32 is fifty-one. It is unrealistic to envision a person operating the hand-pump continuously for fifty-one strokes during inverted operation, which would admit fresh air to the bottle. As a result, it is unlikely that a condition would arise when the storage volume 32 would need to be as large as 0.36 in$^3$. It should be noted also that a practical sized liquid orifice 32 could be smaller than 0.020 in. diameter and consequently decrease the size of the storage volume in proportion to the diameter squared of the orifice.

From the above, a general relation can be written for determining the size of the storage volume:

$$V=CA(2gH)^{1/2}[V_b/(V_S\times S)] \quad (2)$$

Where: V=size of storage volume (in$^3$),

C=coefficient of discharge through liquid control orifice (0.6),

A=cross-sectional area of liquid control orifice (in$^2$), g=acceleration of gravity (386.4 in/sec$^2$), H=height of the liquid level in the bottle above the liquid control orifice (in), $V_b$=volume of the liquid that must be removed from the bottle to reduce air pressure therein to a value of (H×d) below atmospheric pressure, (in$^3$), $V_S$=volume of liquid dispensed for each stroke of the hand-pump (in$^3$), S=number of strokes of the hand-pump per second (1/sec).

Figure 1:
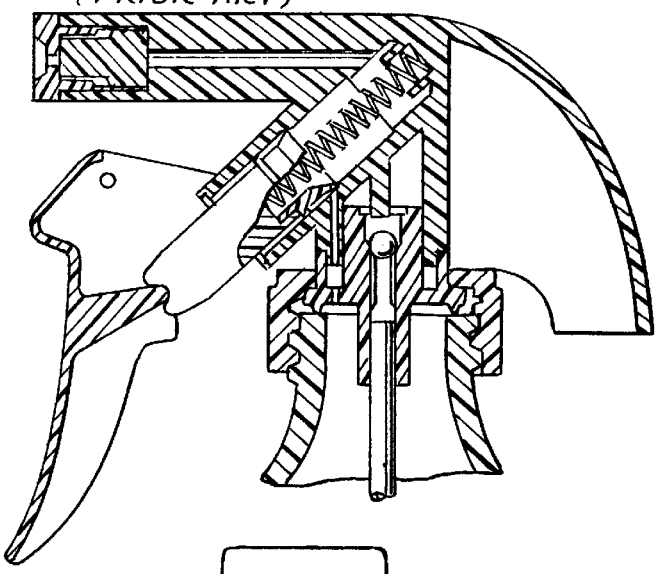
FIG. 1 (PRIOR ART)
FIG. 1 is a sectional elevation of the hand-pump, at an enlarge scale, showing the capillary tube of a prior art pump sprayer.
Figure 2:
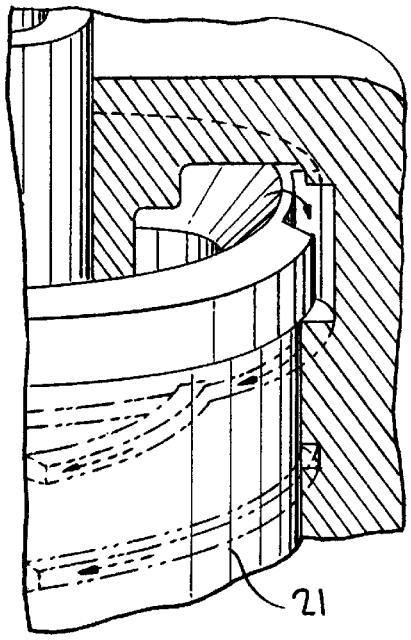
FIG. 2 (PRIOR ART)
FIG. 2 is a perspective view, at an enlarge scale, showing part of the spiral vent groove of another prior art pump sprayer.

The above example has shown that a cylindrical bottle would require a storage volume of 0.034 in$^3$ and a flat-sided bottle would require a storage volume of 0.36 in$^3$. Consider a capillary tube 10, 11 of the U.S. Pat. No. 4,072,252 patent sprayer (FIG. 1) as being 0.020 in diameter. It will allow 0.034 in.$^3$ to leak from a cylindrical bottle and 0.36 in$^3$ from a flat-sided bottle. Both quantities are undesirable leakages. The spiral groove of the U.S. Pat. No. 5,353,969 patent sprayer (FIG. 2) having a diameter of 0.020 in. would have to be 108 in. long to prevent leakage in a cylindrical bottle and 1146 in. long to prevent leakage in a flat-sided bottle. Incorporating a spiral groove of either length in a hand-pump is not reasonable. In addition, it is not possible to decrease the required length of the spiral groove by decreasing the cross-sectional flow area. Although a smaller cross-sectional area would decrease the flow rate, it would also decrease the volume in proportional amount and result in the same required length. It is seen that the present invention overcomes the problems noted for the aforedescribed prior art sprayers.

Figure 6A:
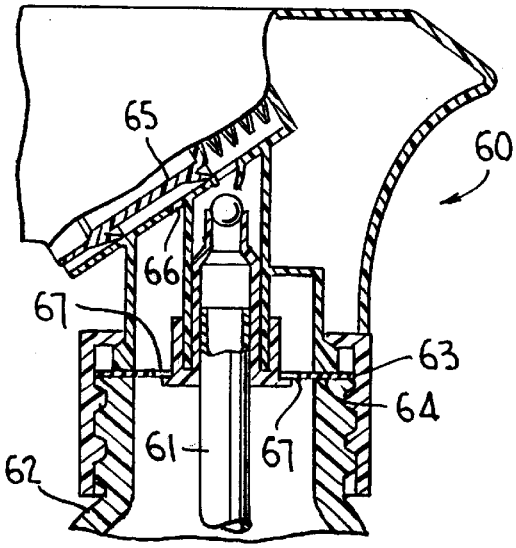
FIG. 6A (PRIOR ART)
FIGS. 6A and 6B are vertical sectional views of a prior art trigger sprayer shown in upright and inverted positions.

FIG. 6A illustrates a portion of a prior art hand-pump trigger sprayer 60 as shown in U.S. Pat. No. 5,779,108.

Figure 6B:
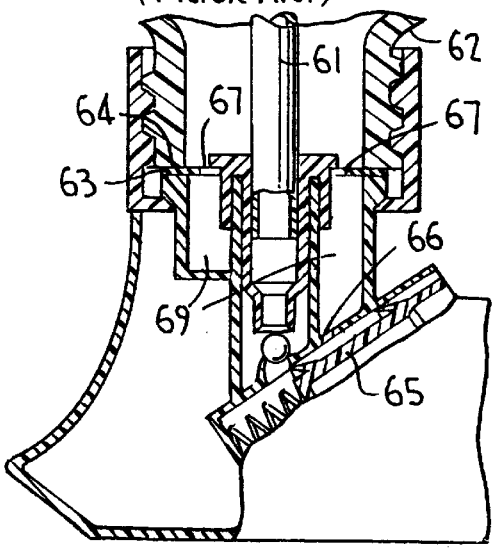
FIG. 6B (PRIOR ART)

The dip tube 61 allows liquid from the bottle 62 to enter the hand-pump 60 during upright operation. The gasket 63 seals the hand-pump 60 against the bottle 62 to prevent leakage from the interior of the bottle through interface 64. As described in the '108 patent, a vent seal on piston 65 that operates the hand-pump opens an annular vent chamber to the atmosphere to uncover the air inlet vent port 66 during a portion of both the suction and discharge strokes. In the inverted position, FIG. 6B, the liquid from the bottle can flow unrestricted through the gasket passage 67 into space 69 and to the air inlet vent port 66. (Passage 67 is formed by the four corners of a rectangular central opening in the gasket through which a cylindrical dip tube retainer 61*a* extends.) When the hand-pump 60 is operated, liquid can then flow through the air inlet vent port 66 to the operator's hand or to the atmosphere. This would be an undesirable condition since it is a waste of product and is unpleasant to the operator.

Figure 7:
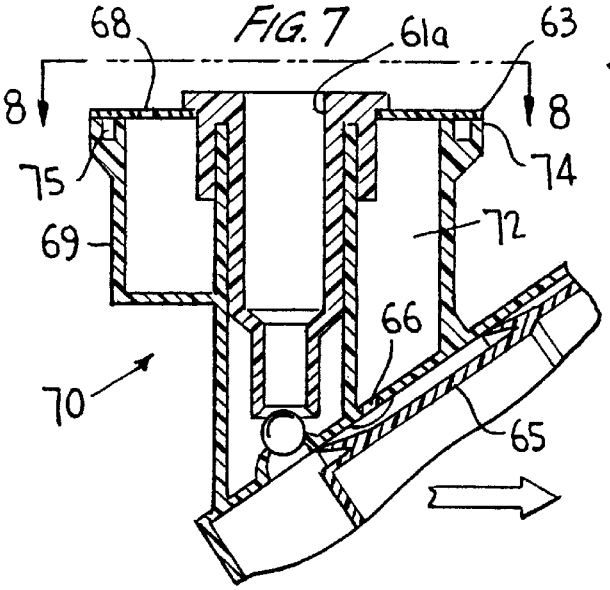
FIG. 7 is a view similar to FIG. 6A incorporating the invention, showing the sprayer in the inverted position of FIG. 5D.
Figure 10:
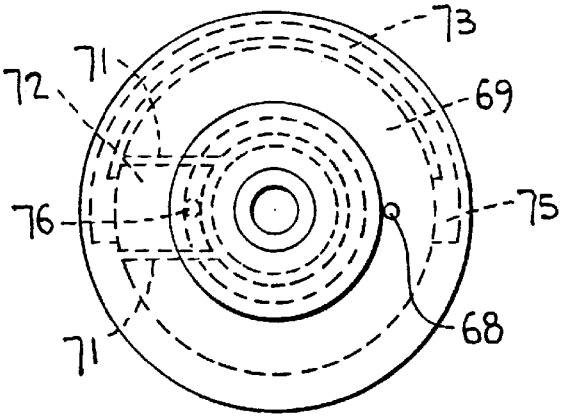
FIG. 10 is a bottom plan view taken substantially along the line 10—10 of FIG. 9A.

FIG. 7 illustrates a trigger sprayer 70 which is essentially trigger sprayer 60 that has been modified according to the invention from that shown in FIG. 6 to prevent leakage during inverted operation, shown as fully inverted. The heavy arrow indicates the direction of spray. The dip tube 61 and tube retainer 61*a* of the hand-pump are unchanged. However, the gasket 63 is fabricated to have a circular central opening through which the cylindrical tube retainer 61*a* extends to thereby eliminate passages 67.

Figure 8:
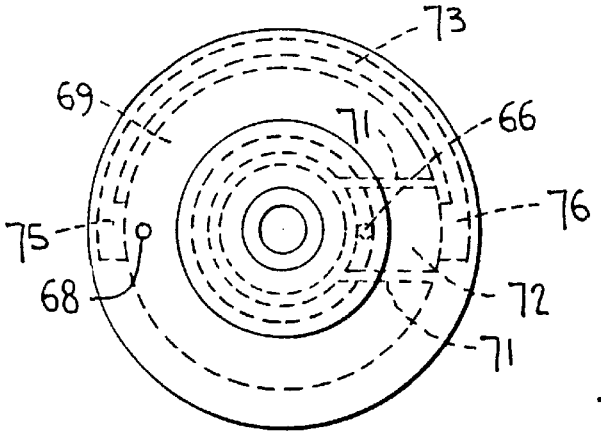
FIG. 8 is a bottom plan view taken substantially along the line 8—8 of FIG. 7.

A small hole 68 provided in the gasket 63 forms a fluid path between the interior of the bottle 62 and void space 69. The air inlet port 66 is bounded by a pair of spaced walls 71 in space 69 (FIG. 8) and is sealed by the gasket 63 in order to form space 72 that is separated from space 69 by the walls 71. A channel 73 is formed in end wall 74 of sprayer 70 which forms a sealing interface between the sprayer 70 and the bottle 62. Channel 73 opens at one end as at 75 (FIG. 8) into hole 68, and opens at its opposite end as at 76 into space 72.

The four components of the air inlet unit 30 of the present invention (FIG. 3A) will be related to the components of pump sprayer 70 in describing the operation of sprayer 70. The hole 68 in the gasket 63 corresponds to the liquid control orifice 31 of FIG. 3. The space 69 corresponds to the storage volume 32 of FIG. 3. The end opening 75 of the channel 73 corresponds to the entrance 33 to the extension tube 34 of FIG. 3. The channel 73 which communicates with the space 72 via its end opening 76 corresponds to the extension tube 34 of FIG. 3. The air inlet port 66 corresponds to the air inlet port 35 of FIG. 3.

It is seen that the air inlet unit 30 of FIG. 3 is effectively incorporated into the prior art pump sprayer 60 to form the non-leak pump sprayer 70 according to the invention. The volume of the space 69 in the prior art hand-pump 60 is more than 0.36 in.$^3$ so that all of the liquid that would have leaked without the air inlet unit being contained in such space 69 of the modified hand-pump 70. The result is a non-leak hand-pump with no moving parts and no additional parts. After the manufacturing dies are modified, there is no additional cost to produce the non-leak hand-pump 70. A similar modification to other hand-pumps is possible with the same results.

Figure 9C:
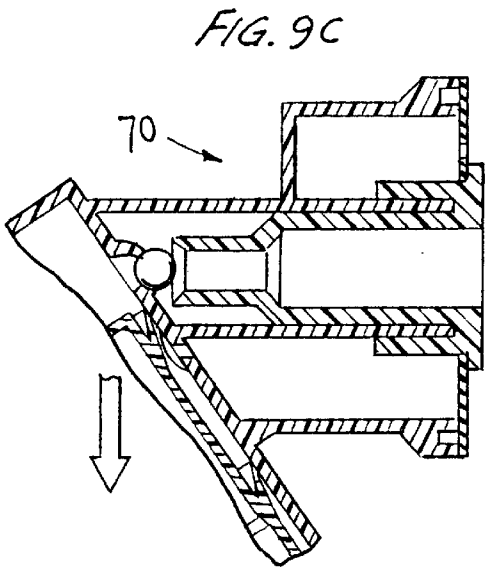
FIGS. 9A, 9B, 9C are views similar to FIG. 6A incorporating the invention, showing the sprayer in upright and downward positions, FIGS. 9AA, 9BB, 9CC illustrating in diagrammatical form the quantity of liquid that must be contained in the storage volume for the various orientations.
Figure 9C:
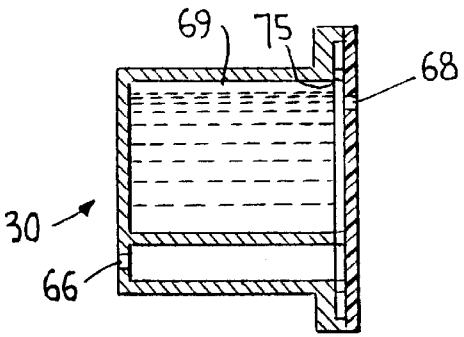
Figure 9B:
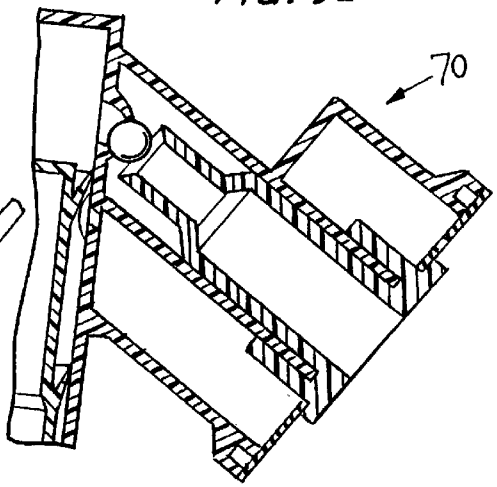
Figure 9B:
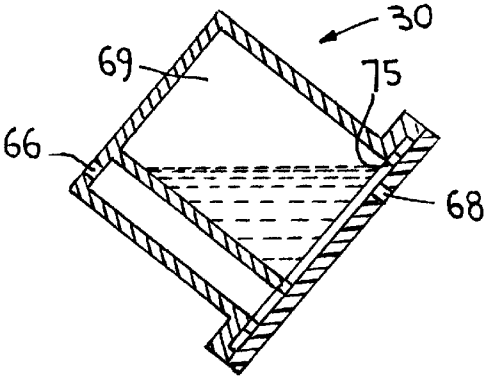
Figure 9A:
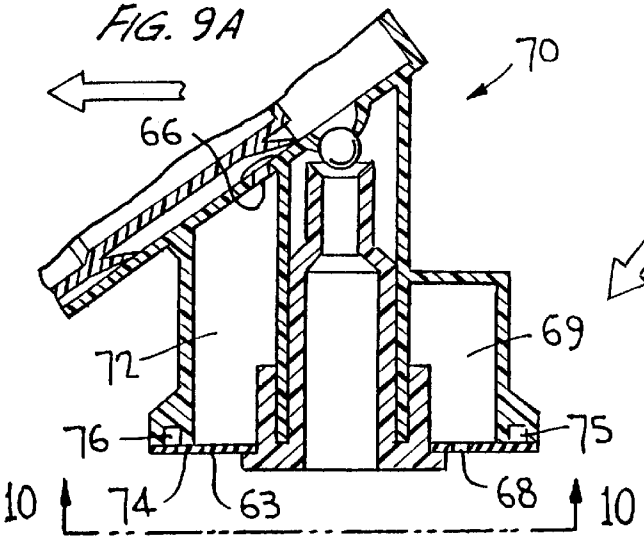
Figure 9A:
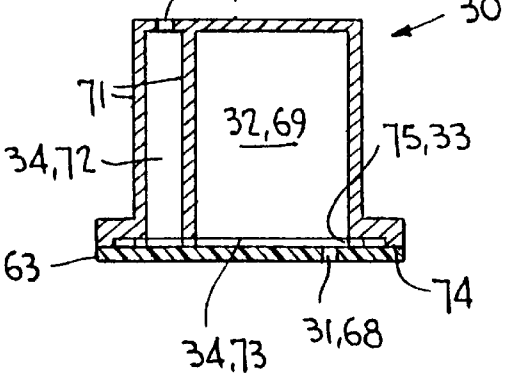

FIG. 9A shows the hand-pump 70 incorporating the invention for upright spray such that the four components of unit 30 are arranged as in FIG. 9AA which compares with FIG. 5AA.

FIGS. 9B and 9C show hand-pump 70 in downward spray positions, the bold arrows of FIG. 9A, 9B, 9C, indicating the direction of the spray. FIGS. 9BB, 9CC show the unit 30 as adapted to a hand-pump and oriented to illustrate the manner in which the liquid in space 69 cover hole 68.

Also, in the FIG. 9 illustrations it can be seen that the extension tube entrance 75 is always above the liquid control orifice 68 so that liquid that flows through control orifice 68 will fall into the storage volume 69 and will not reach air inlet port 66. Thus no fluid will leak from the trigger sprayer in the downward positions, or in the inverted positions described hereinabove.

What is claimed is:

1. A manually operated pump sprayer that will not leak liquid through an air inlet vent port when operated at an orientation at which said air inlet vent port would be covered with liquid when the sprayer is mounted on a bottle of liquid to be dispensed, but will admit air to replace the liquid that is dispensed, comprising:

an air inlet unit having a liquid control orifice that is sized so as to control the rate of liquid flow therethrough, said liquid control orifice being in fluid communication with a storage volume of said unit that is sized so as to act as a reservoir to hold any said liquid that flows through said liquid control orifice, an extension tube of said unit in open communication at one entrance end thereof with said storage volume and at an opposite end thereof with said air inlet vent port, said one end of said extension tube being above the liquid level in the storage volume so as to prevent liquid from entering the extension tube, and said air inlet vent port being sized to admit air into the bottle to replace the liquid that is dispensed.

2. The pump sprayer according to claim 1, wherein said liquid control orifice has an area of predetermined size such that upon operation of the sprayer in an inverted position sufficient liquid is dispensed to lower pressure within the bottle to a value equal to atmospheric pressure minus the product of the height of the liquid above the liquid control orifice and a given density of the liquid, while said liquid control orifice restricts the volume of flow therethrough to be less that the storage volume.

3. The pump sprayer according to claim 1, wherein said liquid control orifice has an area determined by the relation:

$$A=V/\{C(2gH)^{1/2}[V_b/(V_S\times S)]\}$$

wherein: V=size of the storage volume;

C=coefficient of discharge through the liquid control orifice;

A=cross-sectional area of the liquid control orifice;

g=acceleration of gravity;

H=height of the liquid level in the bottle above the liquid control orifice;

$V_b$=volume of liquid that must be removed from the bottle to reduce air pressure therein to a value of (H×d) below atmospheric pressure;

$V_S$=volume of liquid dispensed for each stroke of the pump sprayer; and

S=number of strokes of the pump sprayer per second.

4. The pump sprayer according to claim 1, wherein the one entrance end to the extension tube is located in the storage volume at a first distance from a liquid discharge opening of the sprayer, and the liquid control orifice is located at a second distance from the discharge opening which is less than said first distance, such that when spraying in a downward direction the one entrance end is above the liquid level in the storage volume.

5. The pump sprayer according to claim 1, wherein the one entrance end to the extension tube is located in the storage volume at a first distance from a liquid discharge opening of the sprayer, and the liquid control orifice is located at a second distance from the discharge opening which is greater than the said first distance such that when spraying in an upward direction the one entrance end is always above the liquid level in the storage volume.

* * * * *